US011306918B2

(12) United States Patent
Folkers et al.

(10) Patent No.: US 11,306,918 B2
(45) Date of Patent: Apr. 19, 2022

(54) TURBULATOR GEOMETRY FOR A COMBUSTION LINER

(71) Applicant: Chromalloy Gas Turbine LLC, Palm Beach Gardens, FL (US)

(72) Inventors: Daniel L. Folkers, Stuart, FL (US); Vincent C. Martling, Wellington, FL (US); Zhenhua Xiao, West Palm Beach, FL (US); John Bacile, Wellington, FL (US)

(73) Assignee: Chromalloy Gas Turbine LLC, Palm Beach Gardens, FL (US)

( * ) Notice: Subject to any disclaimer, the term of this patent is extended or adjusted under 35 U.S.C. 154(b) by 203 days.

(21) Appl. No.: 16/179,143

(22) Filed: Nov. 2, 2018

(65) Prior Publication Data

US 2020/0141576 A1 May 7, 2020

(51) Int. Cl.
*F23R 3/00* (2006.01)

(52) U.S. Cl.
CPC .... *F23R 3/002* (2013.01); *F23R 2900/03045* (2013.01)

(58) Field of Classification Search
CPC ..... F23R 3/002; F23R 2900/03045; F05D 2260/2212
See application file for complete search history.

(56) References Cited

U.S. PATENT DOCUMENTS 4,077,205 A 3/1978 Pane et al.
5,353,865 A * 10/1994 Adiutori ..... F28F 13/02 165/133
6,468,669 B1 * 10/2002 Hasz ..... B32B 15/01 428/553
6,681,578 B1 1/2004 Bunker
7,007,482 B2 3/2006 Green et al.
7,386,980 B2 6/2008 Green et al.
7,540,156 B2 6/2009 Brown et al.
8,220,273 B2 7/2012 Iwasaki
8,245,514 B2 * 8/2012 Tu ..... F23R 3/005 60/752
8,544,277 B2 * 10/2013 Johnson ..... F23R 3/005 60/752
8,915,087 B2 * 12/2014 McMahan ..... F23R 3/005 60/772
9,511,447 B2 12/2016 Lin et al.
2003/0233832 A1 * 12/2003 Martling ..... F23R 3/06 60/776
2004/0079082 A1 * 4/2004 Bunker ..... F23M 5/00 60/752
2006/0042255 A1 * 3/2006 Bunker ..... F01D 25/14 60/752

(Continued)

OTHER PUBLICATIONS

PCT Application No. PCT/US19/59412, International Search Report and Written Opinion, dated Jan. 21, 2020, 11 pages.

*Primary Examiner* — William H Rodriguez
(74) *Attorney, Agent, or Firm* — Avek IP, LLC

(57) ABSTRACT

A heat transfer mechanism is provided comprising a plurality of turbulators located along a surface of a body, such as a combustion liner. The turbulators have a first side with a first ramp angle, a second side with a second ramp angle, a height, and a base width, where the base width is a function of the height and where the turbulators are spaced an axial distance apart that is a function of the turbulator height.

19 Claims, 5 Drawing Sheets

(56) References Cited

U.S. PATENT DOCUMENTS

2008/0264065 A1* 10/2008 Gerendas ..... F23R 3/007 60/754
2009/0145132 A1* 6/2009 Johnson ..... F23R 3/002 60/755
2010/0223931 A1* 9/2010 Chila ..... F23R 3/005 60/760
2011/0120141 A1* 5/2011 Geary ..... F23R 3/60 60/796
2011/0203287 A1* 8/2011 Chila ..... F02K 9/346 60/758
2012/0121381 A1* 5/2012 Charron ..... F01D 25/12 415/115
2012/0208141 A1* 8/2012 Siddagangaiah ..... F23R 3/002 431/350
2012/0247111 A1* 10/2012 Narcus ..... F23R 3/005 60/752
2012/0275900 A1* 11/2012 Snider ..... F01D 25/12 415/108
2012/0304654 A1* 12/2012 Melton ..... F23R 3/002 60/746
2013/0047618 A1* 2/2013 Gregory ..... F23R 3/002 60/722
2014/0020393 A1* 1/2014 Nakamata ..... F23R 3/002 60/754
2014/0060063 A1* 3/2014 Boardman ..... F23R 3/286 60/772
2016/0025341 A1* 1/2016 Lin ..... B23K 31/02 60/752
2016/0115799 A1* 4/2016 Lin ..... B23K 9/046 60/752
2016/0209034 A1 7/2016 Maurer et al.
2016/0238249 A1* 8/2016 Cunha ..... F23R 3/005
2017/0003027 A1* 1/2017 Kostka ..... F23R 3/06
2017/0159487 A1* 6/2017 Stapleton ..... B28B 11/24
2017/0176006 A1* 6/2017 Gerendas ..... F23R 3/06
2018/0372428 A1* 12/2018 Lin ..... F28F 13/12
2019/0041059 A1* 2/2019 Slavens ..... F02C 7/18
2019/0049115 A1* 2/2019 Shenny ..... F23R 3/002
2019/0063750 A1* 2/2019 Porter ..... F23R 3/005
2019/0072276 A1* 3/2019 Porter ..... F23R 3/005
2019/0086083 A1* 3/2019 Kim ..... F23R 3/005
2019/0101287 A1* 4/2019 Tsuru ..... F23R 3/005
2019/0107054 A1* 4/2019 Park ..... F23R 3/44
2019/0128187 A1* 5/2019 Shenny ..... F23R 3/002
2019/0249875 A1* 8/2019 Gandikota ..... F23R 3/16

* cited by examiner

FIG. 1 – PRIOR ART

TURBULATOR GEOMETRY FOR A COMBUSTION LINER

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This disclosure relates generally to a heat transfer mechanism for use on a surface of a component subjected to elevated temperatures in a gas turbine engine and more specifically to aspects of a turbulator configuration for a combustion system.

BACKGROUND OF THE DISCLOSURE

A gas turbine engine typically comprises a multi-stage compressor coupled to a multi-stage turbine via an axial shaft. Air enters the gas turbine engine through the compressor where its temperature and pressure increase as it passes through subsequent stages of the compressor. The compressed air is then directed to one or more combustors where it mixes with a fuel source to create a combustible mixture. This mixture is ignited in the combustors to create a flow of hot combustion gases. These gases are directed into the turbine causing the turbine to rotate, thereby driving the compressor. The output of the gas turbine engine can be mechanical thrust through exhaust from the turbine or shaft power from the rotation of an axial shaft, where the axial shaft can drive a generator to produce electricity.

The compressor and turbine each comprise a plurality of rotating blades and stationary vanes having an airfoil extending into the flow of compressed air or flow of hot combustion gases. Each blade or vane has a particular set of design criteria which must be met in order to provide the necessary work to the passing flow through the compressor and the turbine.

Combustion liners frequently contain reactions of fuel and air reaching upwards of 4000 deg. F. To prevent melting and/or erosion of the combustion liner, the combustion liner is typically covered with a protective thermal barrier coating on the surface of the liner in direct contact with the hot combustion gases. The benefit obtained by the thermal barrier coating is a function of the composition and coating thickness, but can reduce combustion liner temperature by approximately 160 deg. F. However, a thermal barrier coating alone is not always enough to protect the combustion liner from the hot combustion gases passing therethrough. Active cooling can be incorporated in the form of cooling holes, where air cooler than the hot combustion gases passes therethrough to cool the wall of the combustion liner. Furthermore, cooling air can pass along an outer surface of the combustion liner in order to cool a backside of the combustion liner.

An example of backside cooling techniques is shown in FIG. 1 where the combustion liner 100 comprises a series of raised edges or perturbances 102 positioned along a limited portion, such as the upper portion 104, of the combustion liner 100.

BRIEF SUMMARY OF THE DISCLOSURE

The present disclosure discloses an improved heat transfer system and process for actively cooling a heated surface, such as that used in conjunction with a combustion liner having a surface requiring active cooling.

In an embodiment of the present disclosure, a combustion liner comprises a generally annular body having a first cylindrical portion, a conical portion, and a second cylindrical portion. The combustion liner also comprises an inlet end proximate the first cylindrical portion and an outlet end proximate the second cylindrical portion. A plurality of turbulators are located along an outer surface of the first cylindrical portion and the conical portion, where the turbulators have a first side with a first ramp angle, a second side with a second ramp angle, a height, and a base width extending between the first side and the second side.

In an alternate embodiment of the present disclosure, a heat transfer mechanism for a gas turbine component is provided. The heat transfer mechanism comprises a plurality of turbulators located along an outer surface of a body, where the plurality of turbulators each have a base width, a first side with a first ramp angle, a second side with a second ramp angle, where the first side is connected to the second side at a peak having a height. The plurality of turbulators are spaced apart by an axial distance.

In yet another embodiment of the present disclosure, a method of providing a heat transfer mechanism is provided. The method comprises providing a body having a surface for the heat transfer mechanism and forming the heat transfer mechanism in the surface of the body. The heat transfer mechanism comprises a plurality of turbulators located along an outer surface of the body where the plurality of turbulators each comprise a first side with a first ramp angle and a second side with a second ramp angle where the first side is connected to the second side at a peak having a height where the peak has a full round tip radius. The plurality of turbulators also have a base with a base width and the plurality of turbulators are spaced apart by an axial distance.

These and other features of the present disclosure can be best understood from the following description and claims.

BRIEF DESCRIPTION OF THE SEVERAL VIEWS OF THE DRAWINGS

The present disclosure is described in detail below with reference to the attached drawing figures, wherein.

DETAILED DESCRIPTION

The following presents a simplified summary of the disclosure to provide a basic understanding of some aspects thereof. This summary is not an extensive overview of the application. It is not intended to identify critical elements of the disclosure or to delineate the scope of the disclosure. Its sole purpose is to present some concepts of the disclosure in a simplified form as a prelude to the more detailed description that is presented elsewhere herein.

The present disclosure is intended for use in a gas turbine engine, such as a gas turbine engine used for power generation. As such, the present disclosure is capable of being used in a variety of turbine operating environments, regardless of the manufacturer.

As those skilled in the art will readily appreciate, a gas turbine engine is circumferentially disposed about an engine centerline, or axial centerline axis. The engine includes a compressor, a combustion section and a turbine with the turbine coupled to the compressor via an engine shaft. As is well known in the art, air compressed in the compressor is mixed with fuel which is burned in the combustion section and expanded in turbine. The air compressed in the compressor is mixed with fuel and the gases are expanded in the turbine. The turbine includes rotors that, in response to the fluid expansion, rotate, thereby driving the compressor. The turbine comprises alternating rows of rotary turbine blades, and static airfoils, often referred to as vanes.

Figure 1:
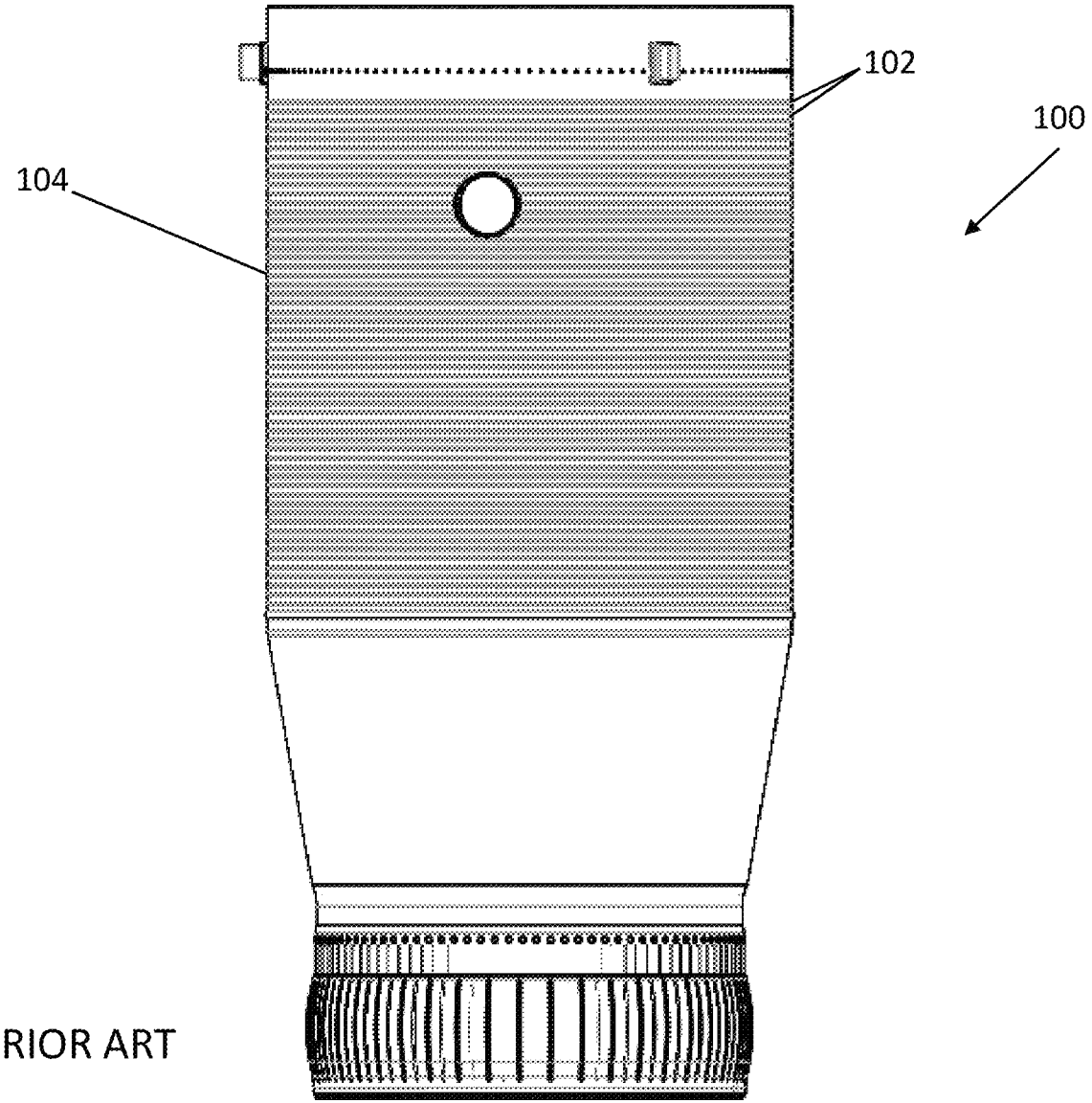
FIG. 1 is an elevation view of a combustion liner for a gas turbine engine.
Figure 2:
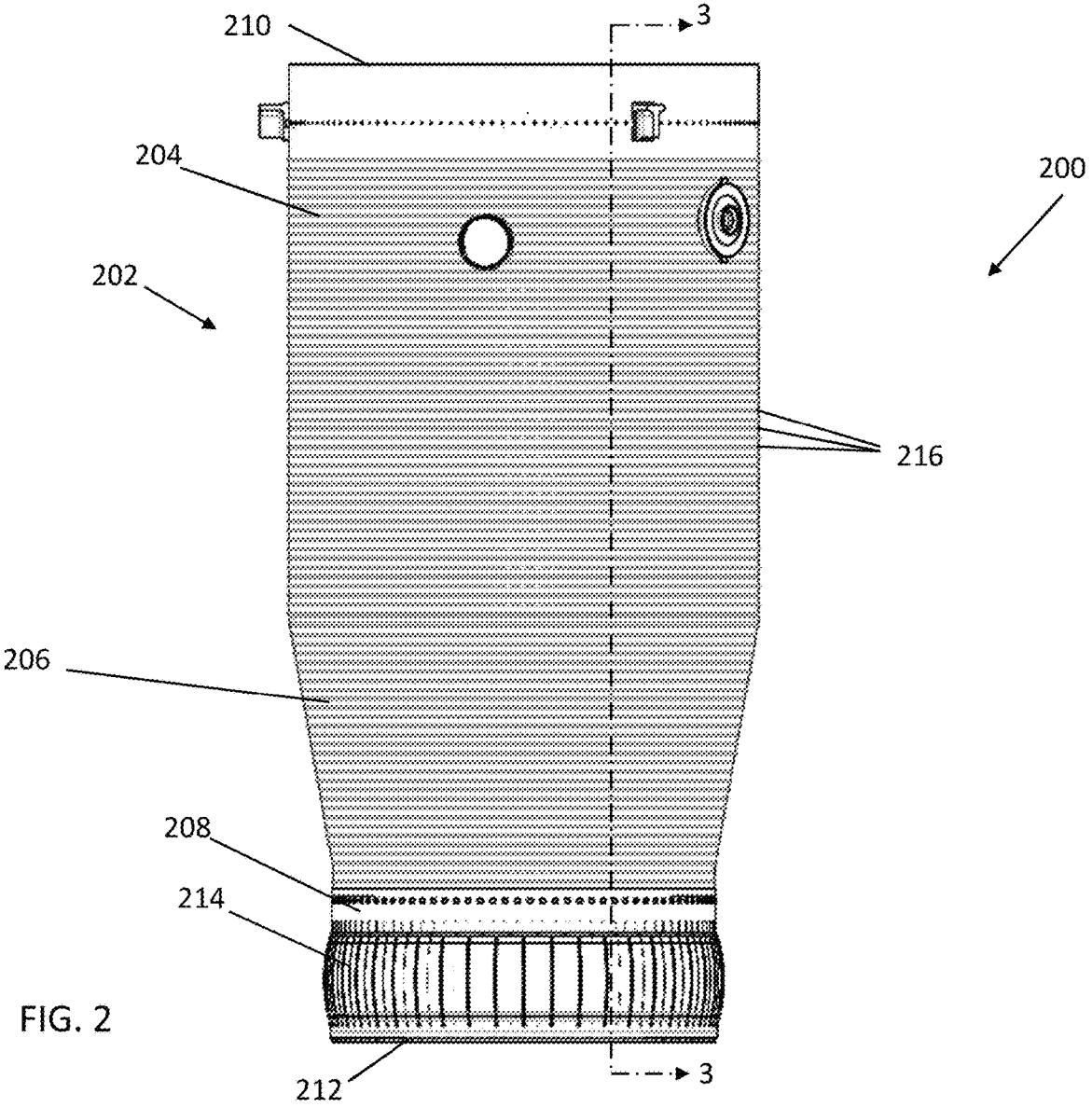
FIG. 2 is an elevation view of a combustion liner in accordance with an embodiment of the disclosure.

Various embodiments of the present disclosure are depicted in FIGS. 2-6. Referring initially to FIG. 2, a combustion liner 200 for use in a gas turbine engine is provided. The combustion liner 200 comprises a generally annular body 202 having a first cylindrical portion 204, a conical portion 206 connected to the first cylindrical portion 204, and a second cylindrical portion 208 connected to the conical portion 206. The combustion liner 200 also has an inlet 210 proximate the first cylindrical portion 204 and an outlet 212 proximate the second cylindrical portion 208.

In an industrial gas turbine engine, compressed air enters the combustion liner 200 through the inlet 210 where the compressed air mixes with fuel from one or more fuel nozzles, where the one or more fuel nozzles are also positioned adjacent the inlet 210. Proximate the outlet 212 and the second cylindrical portion 208 is a sealing mechanism 214 for sealing the outlet 212 of the combustion liner 200 to an adjacent component, such as a transition duct. The sealing mechanism 214 can be a slotted spring seal comprising of a plurality of sheet metal fingers capable of being compressed when a force, such as that from a mating engine component, is applied to the sealing mechanism 214.

Referring now to FIGS. 2-5, the combustion liner 200 also comprises a plurality of turbulators 216 positioned along an outer surface 218 of the first cylindrical portion 204 and the conical portion 206. The turbulators 216 are positioned across generally the entire length of the first cylindrical portion 204 and conical portion 206 in order to provide a more effective cooling configuration over the prior art.

Figure 3:
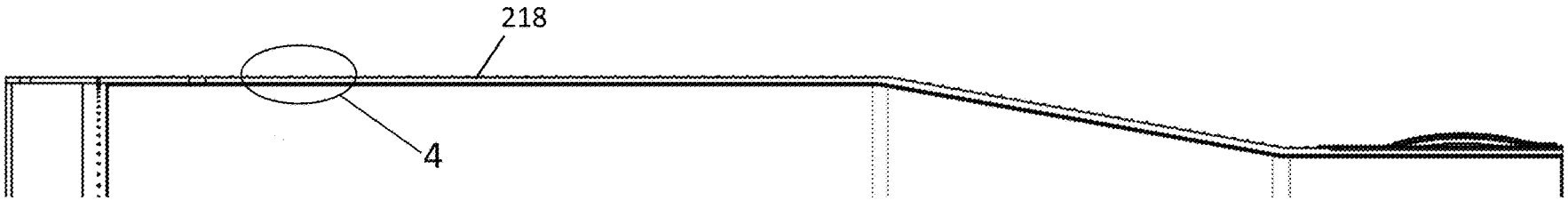
FIG. 3 is a cross section view of the combustion liner of FIG. 2 in accordance with an embodiment of the present disclosure.
Figure 4:
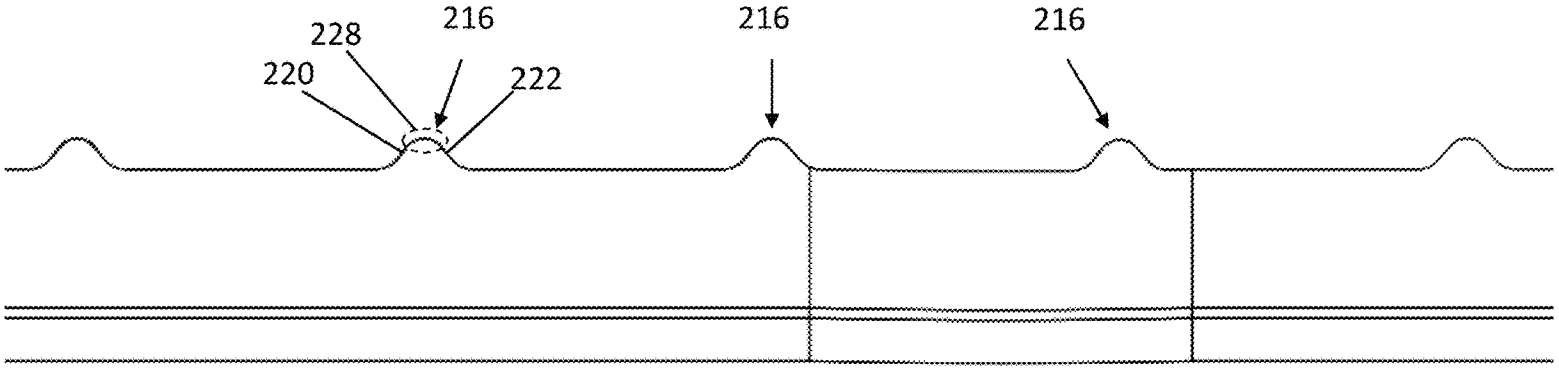
FIG. 4 is a detailed cross section view of a portion of the combustion liner of FIG. 3.
Figure 5:
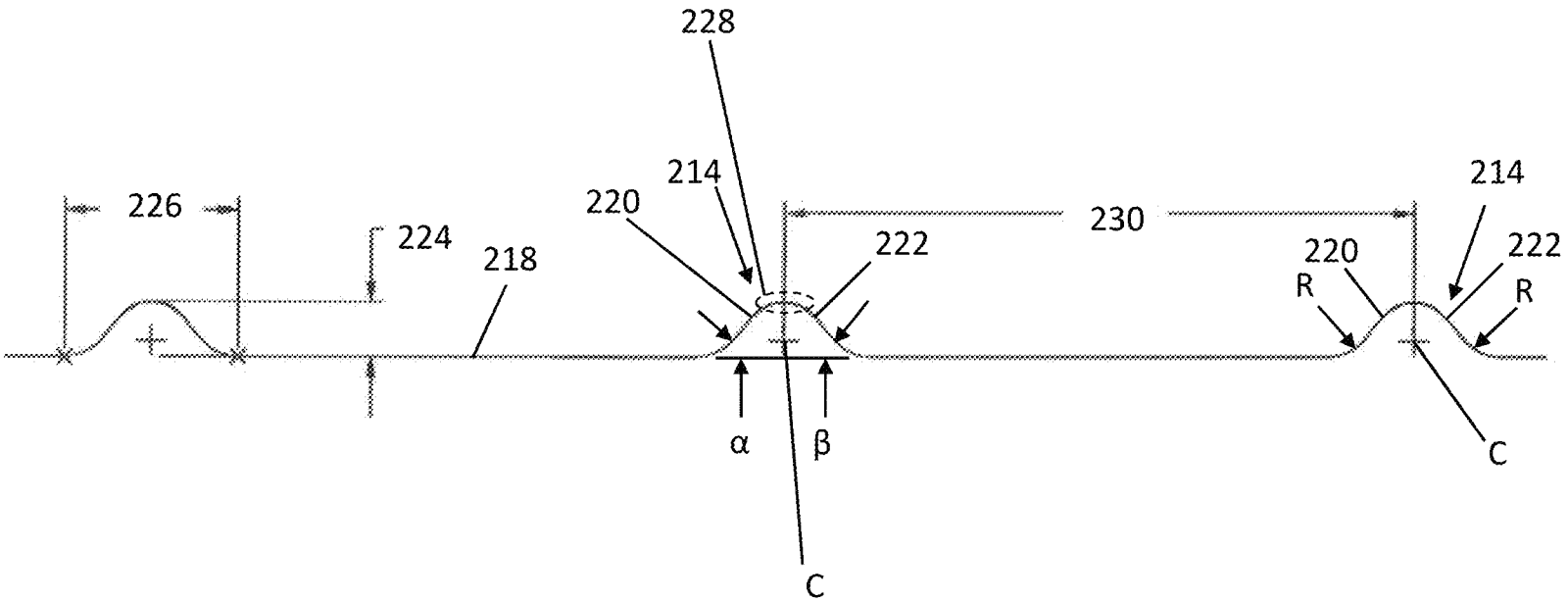
FIG. 5 is an alternate cross section view of a portion of the combustion liner of FIG. 3.
Figure 6:
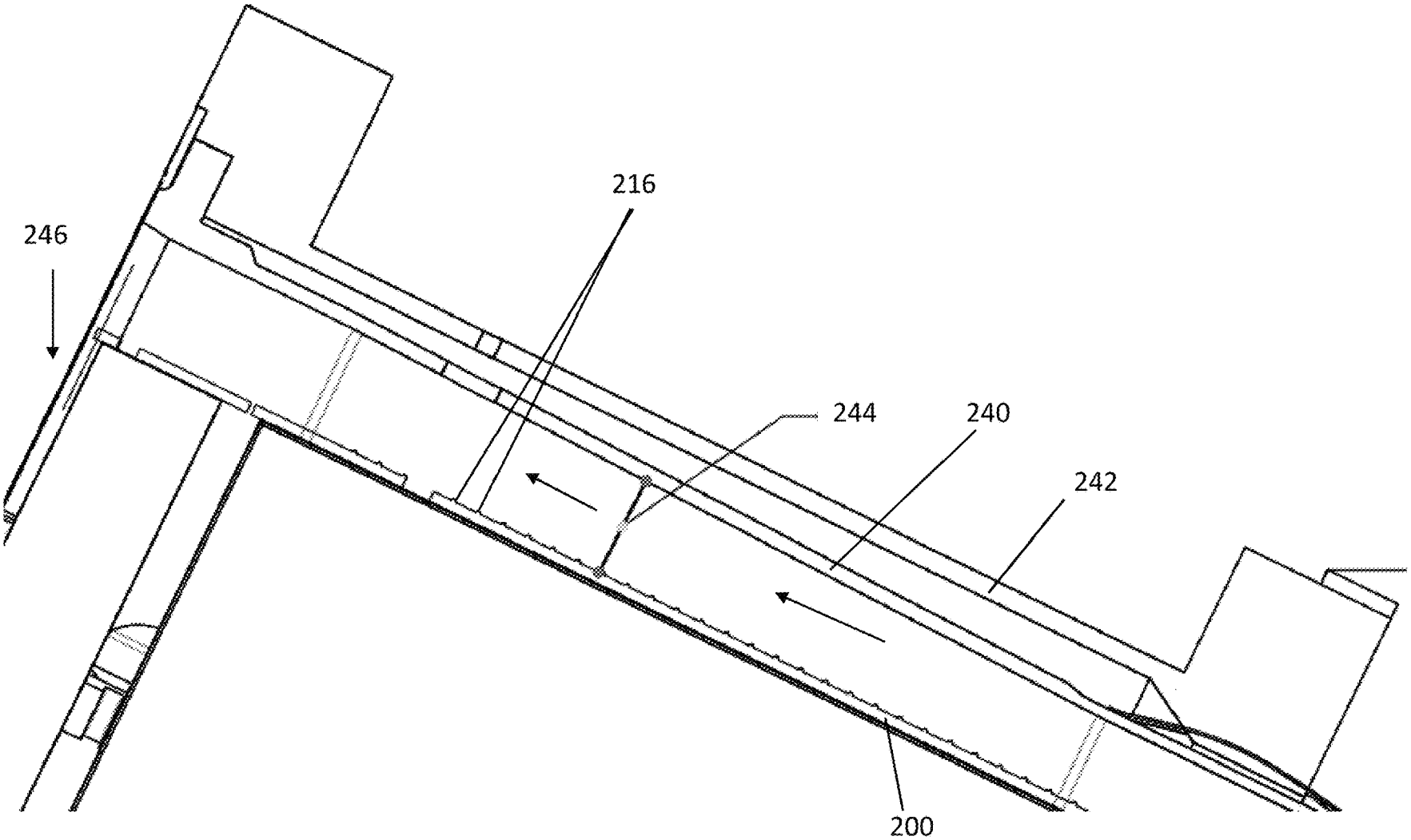
FIG. 6 is a cross section view of a portion of a gas turbine combustor in accordance with an embodiment of the present disclosure.

More specific details of the turbulators 216 are shown in FIGS. 3-5. Referring to FIGS. 4 and 5, the plurality of turbulators 216 each have a first side 220 with a first ramp angle $\alpha$ and a second side 222 with a second ramp angle $\beta$. The turbulators 216 also have a height 224 extending away from the outer surface 218 and a width 226, where the width 226 is measured from a tangent between each of the first side 220 and second side 222 and the outer surface 218. In the embodiment depicted in FIG. 5, the turbulators 216 comprise a base fillet radius R between the first side 220 and the outer surface 218 and the second side 222 and the outer surface 218 along the first cylindrical portion 204 and the conical portion 206. The exact size of base fillet radius R can be the same or vary as it is not believed to greatly impact heat transfer or pressure loss as air passes over the turbulators 216. The first side 220 and second side 222 are joined together at a tip region 228. In the embodiment shown in FIGS. 4 and 5, the tip region 228 includes a full round radius.

In general, the plurality of turbulators 216 are axisymmetric. For example, and as depicted in FIGS. 4 and 5, each of the plurality of turbulators 216 has a generally triangular cross section with a plurality of radii at its corners. While the exact size and shape of the plurality of turbulators 216 can vary, the embodiment depicted in FIGS. 3-5 includes a base width 226 that is approximately 1-3 times larger than the height 224. For an embodiment of the disclosure, the height 224 of the turbulator 216 is approximately 0.030 inches while the base width is approximately 0.090 inches wide, or about three times the height 224.

The first ramp angle $\alpha$ and the second ramp angle $\beta$ can also vary depending on the preferred cooling design of the turbulators 216 and combustion liner 200. For the embodiment depicted in FIGS. 3-5, the first ramp angle $\alpha$ and the second ramp angle $\beta$ are approximately 30-45 degrees, as measured from a surface of the first cylindrical portion 204 or the conical portion 206. Depending on the configuration of turbulators 216, the first ramp angle $\alpha$ and the second ramp angle $\beta$ can be the same or can be different.

In addition to the specific size and shape of the plurality of turbulators 216, the position of the turbulators 216 can also vary. More specifically, the plurality of turbulators 216 have an axial spacing 230 as measured between centerpoints C of adjacent turbulators 216. For the embodiment depicted in FIGS. 3-5, the axial spacing 230 is approximately 0.34 inches, which, for the height 224 of 0.030 inches is slightly greater than 10 times the height. The axial spacing 230 can be approximately 10-20 times the height 224.

In an alternate embodiment of the disclosure, a method of providing a heat transfer mechanism is disclosed. The method comprises providing a body having a surface for the heat transfer mechanism and forming the heat transfer mechanism in the surface of the body. The heat transfer mechanism comprises a plurality of turbulators where each turbulator comprises a first side with a first ramp angle and a second side with a second ramp angle, where the first side is connected to the second side at a tip region having a height and a full round tip radius. The plurality of turbulators are spaced apart by an axial distance.

The plurality of turbulators 216 are provided to enhance the heat transfer along a surface subject to high temperature loads. While the turbulators 216 can be located on an outer surface 218, as shown in FIGS. 3-6, the turbulators 216 can also be incorporated along an inner surface, depending on the heat transfer requirements of the component.

The heat transfer mechanism can be incorporated into the surface of the body through a variety of means. For example, in an embodiment of the disclosure, the plurality of turbulators can be machined into the surface of the body. Alternatively, the plurality of turbulators can be cast into the surface of the body as part of the body itself. In addition, the plurality of turbulators can be separately fabricated and secured to the surface of the body, such as through a brazing process.

One such use of the present disclosure is along an external surface of a combustion liner 200, where the combustion liner 200 is positioned within a flow sleeve 240 and a combustor case 242. The combustion liner 200 and the flow sleeve 240 form a passageway 244 located therebetween and through which air passes (indicated by arrows). The air is directed towards a head end 246 of a combustion system and passes over the plurality of turbulators 216 causing the air to come in contact with a greater surface area of the combustion liner 200 operating at an elevated temperature.

The specific turbulator configuration is determined by maximizing the size of passageway 244 and selecting a height 224 of the turbulator 216 that provides the required level of cooling heat transfer for the airflow and geometry of the passageway 244. The axial spacing 230 is set to minimize pressure loss within the passageway 244 based on the height of the passageway but may be adjusted smaller or larger depending on a streamwise length of the passageway 244.

Although a preferred embodiment of this disclosure has been disclosed, a worker of ordinary skill in this art would recognize that certain modifications would come within the scope of this disclosure. For that reason, the following claims should be studied to determine the true scope and content of this disclosure. Since many possible embodiments may be made of the disclosure without departing from the scope thereof, it is to be understood that all matter herein set forth or shown in the accompanying drawings is to be interpreted as illustrative and not in a limiting sense.

From the foregoing, it will be seen that this disclosure is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

What is claimed is:

1. A combustion liner comprising:

a generally annular body having a first cylindrical portion, a conical portion, and a second cylindrical portion;

a cooling passage formed around the first cylindrical portion;

an inlet proximate the first cylindrical portion and an outlet proximate the second cylindrical portion;

a first plurality of discrete turbulators located along an outer surface of the first cylindrical portion; and a second plurality of discrete turbulators located along an outer surface of the conical portion;

wherein:

each of the first plurality of turbulators are a band with a uniform profile that extends entirely about a circumference of the first cylindrical portion;

each of the second plurality of turbulators are a band with a uniform profile that extends entirely about a circumference of the conical portion;

each of the first plurality of turbulators have a first side extending at a first ramp angle from the outer surface of the first cylindrical portion, a second side extending at a second ramp angle from the outer surface of the first cylindrical portion, a height, and a base width, each of the first plurality of turbulators first and second ramp angles being an acute angle measured from the first cylindrical portion outer surface, wherein a height of one turbulator of the first plurality of turbulators is based on a height of the cooling passage, and an axial spacing of the first plurality of turbulators is based on both the height and a streamwise length of the cooling passage;

each of the second plurality of turbulators have a first side extending from the outer surface of the conical portion at a first ramp angle, a second side extending from the outer surface of the conical portion at a second ramp angle, a height, and a base width, each of the second plurality of turbulators first and second ramp angles being an acute angle measured from the conical portion outer surface.

2. The combustion liner of claim 1 further comprising a sealing mechanism located along an outer surface of the second cylindrical portion.

3. The combustion liner of claim 1, wherein each of the first plurality of turbulators have a generally triangular cross section.

4. The combustion liner of claim 1 further comprising a base fillet radius between each of the first plurality of turbulators first and second sides and the outer surface of the first cylindrical portion.

5. The combustion liner of claim 1, wherein the base width of the first plurality of turbulators is approximately 1-3 times the height of the first plurality of turbulators.

6. The combustion liner of claim 1, wherein the first and second plurality of turbulators are integral with the generally annular body.

7. The combustion liner of claim 4 further comprising a full round radius at a tip region of the first plurality of turbulators, the full round radius being tangential to the first side base fillet radius where the full round radius meets the first side base fillet radius, and the full round radius being tangential to the second side base fillet radius where the full round radius meets the second side base fillet radius.

8. The combustion liner of claim 1, wherein the first plurality of turbulators have an axial spacing of approximately 10-20 times the height of the first plurality of turbulators.

9. The combustion liner of claim 1, wherein each of the first and second plurality of turbulators are axisymmetric.

10. The combustion liner of claim 1, wherein the first plurality of turbulators first ramp angle and the second ramp angle are approximately 30-45 degrees.

11. A heat transfer mechanism for a gas turbine component, the heat transfer mechanism comprising:

a body having a first cylindrical portion, a conical portion, and a second cylindrical portion;

an inlet proximate the first cylindrical portion and an outlet proximate the second cylindrical portion;

a cooling passage formed around each of the first cylindrical portion, and the second cylindrical portion;

a first plurality of discrete turbulators located along an outer surface of the first cylindrical portion, each of the first plurality of turbulators having a uniform profile and being a band which extends entirely about a circumference of the first cylindrical portion;

a second plurality of discrete turbulators located along an outer surface of the conical portion, each of the second plurality of turbulators having a uniform profile and being a band which extends entirely about a circumference of the conical portion;

wherein a height of one turbulator of the second plurality of turbulators is based on a height of the cooling passage, and an axial spacing of the first plurality of turbulators is based on both the height and a streamwise length of the cooling passage.

12. The heat transfer mechanism of claim 11, wherein each of the second plurality of turbulators has a generally triangular cross section.

13. The heat transfer mechanism of claim 12, wherein each of the second plurality of turbulators is axisymmetric.

14. The heat transfer mechanism of claim 11, wherein each of the second plurality of turbulators has an axial spacing of approximately 10-20 times the height.

15. A method of providing a heat transfer mechanism comprising:

providing a body having a surface for the heat transfer mechanism, the body comprising a first cylindrical portion, a conical portion, a second cylindrical portion, and a cooling passage formed around the first cylindrical portion; and forming the heat transfer mechanism in the surface of the first cylindrical portion and the conical portion, where the heat transfer mechanism comprises a plurality of discrete turbulators, the plurality of turbulators each comprising:

a band having a uniform profile extending entirely about a circumference of the body;

a first side with a first ramp angle measured from the surface;

a second side with a second ramp angle measured from the surface;

the first side connected to the second side at a peak, the peak having a height and a full round tip radius; and a base having a base width;

wherein a height of one of the plurality of turbulators is based on a height of the cooling passage, and an axial spacing of the plurality of turbulators is based on both the height and a streamwise length of the cooling passage.

16. The method of claim 15 further comprising a base fillet radius between the first and second sides and the surface of the body.

17. The method of claim 15, wherein the plurality of turbulators are machined into the surface of the body.

18. The method of claim 15, wherein the plurality of turbulators are cast to the surface of the body.

19. The method of claim 15, wherein the first ramp angle and the second ramp angle are each 30-45 degrees and the base is approximately 1-3 times the height.

* * * * *